US006206086B1

(12) United States Patent
McKey

(10) Patent No.: US 6,206,086 B1
(45) Date of Patent: Mar. 27, 2001

(54) MULTI-PASS TUBE SIDE HEAT EXCHANGER WITH REMOVABLE BUNDLE

(75) Inventor: Paul M. McKey, Hamburg, NY (US)

(73) Assignee: R. P. Adams Co., Inc., Tonawanda, NY (US)

( * ) Notice: Subject to any disclaimer, the term of this patent is extended or adjusted under 35 U.S.C. 154(b) by 0 days.

(21) Appl. No.: 09/507,617

(22) Filed: Feb. 21, 2000

(51) Int. Cl.[7] ..... F28F 9/02
(52) U.S. Cl. ..... 165/76; 165/82; 165/158
(58) Field of Search ..... 165/81, 82, 158, 165/76

(56) References Cited

U.S. PATENT DOCUMENTS

| | | | | |
|---|---|---|---|---|
| 11,883 | * | 10/1854 | Sewell | 165/158 X |
| 1,862,310 | * | 6/1932 | How | 165/82 X |
| 2,292,524 | * | 8/1942 | Jacocks | 165/82 |
| 2,340,397 | * | 2/1944 | McNeal | 165/158 |
| 2,956,787 | * | 10/1960 | Raub | 165/82 |
| 2,978,226 | * | 4/1961 | White | 165/82 |
| 3,181,606 | * | 5/1965 | Belanger | 165/158 |
| 3,327,777 | * | 6/1967 | Kovalik et al. | 165/81 |
| 3,332,478 | * | 7/1967 | Saunders | 165/76 |
| 4,244,423 | * | 1/1981 | Thut et al. | 165/82 |
| 4,402,360 | * | 9/1983 | Baron et al. | 165/76 |

* cited by examiner

*Primary Examiner*—Leonard Leo
(74) *Attorney, Agent, or Firm*—Arthur S. Coonfair

(57) ABSTRACT

A multi-pass tubeside shell and tube heat exchanger comprises: a shell having flanged ends; a removable tube bundle having a fixed tubesheet at one end and a floating tube sheet at the opposite end; a false tube sheet bolted to the floating tubesheet and having a passage hole aligned with each tube in the floating tubesheet to direct the flow of tube fluid; and a bonnet having a flange bolted to the outer portion of the false tubesheet. The use of the false tubesheet and attachment of the bonnet to the outer portion thereof maximizes available tube space. With the removal of the bonnet, and the false tubesheet, the bundle can be conveniently removed.

10 Claims, 2 Drawing Sheets

MULTI-PASS TUBE SIDE HEAT EXCHANGER WITH REMOVABLE BUNDLE

BACKGROUND OF THE INVENTION

1. Field of the Invention

This invention relates to shell and tube heat exchangers and in particular to such heat exchangers having a pull-through removable tube bundle.

2. Prior Art

Shell and tube type heat exchangers of various designs are widely used in industry, especially in the chemical process industry. Design details of this type of heat exchanger are extensively described in publications of the Tubular Exchanger Manufacturers Association (TEMA) and in various other engineering publications. A detailed description of TEMA-style shell and tube heat exchangers, including multi-pass tube side heat exchangers as well as other heat exchangers is set forth in Perry's Chemical Engineers' Handbook, $7^{th}$ ed., McGraw-Hill. A number of the designs set forth in these as well as other publications and patents are directed to methods and apparatus for holding and maintaining tubes and tube bundles, especially for ease of removal for maintenance purposes.

U.S. Pat. No. 3,231,012 to Norris discloses a method and apparatus for replacing a seal in an expandable shell double bonnet heat exchanger.

U.S. Pat. No. 3,380,516 to Kaye describes a method and apparatus for providing an expansion joint at the end of each tube in a tube type heat exchanger.

U.S. Pat. No. 3,398,787 to Bevevino discloses the use of an expansion joint to compensate for the movement of the tubesheet as the tubes expand and contract.

U.S. Pat. No. 4,164,255 to Binet et al. discloses a shell and tube heat exchanger wherein an array of tubes is held at each end in a perforated end plate having a flanged support sleeve in each tube hole with the flanges bolted to the outer face of the perforated end plate.

U.S. Pat. No. 4,627,486 to Baron discloses a tube-type heat exchanger wherein the ends of the tubes are held in a tubesheet, extending slightly beyond the outer face of the tubesheet. A retaining plate bolted to the outside of the tubesheet having holes in alignment with each tube end, each hole being large enough to fit over the extended end of the tube.

U.S. Pat. No. 4,635,712 to Baker et al. discloses a high pressure shell and tube heat exchanger utilizing dual tube sheet assemblies, each including an inner tubesheet and an outer tubesheet separated by spacers.

Various multi-pass shell and tube heat exchangers have been designed to improve heat transfer performance by routing the tubeside fluid first through one tube or set of tubes and then reversing the direction of flow by routing the fluid through another tube or set of tubes in the opposite direction. This arrangement requires the use of one or more pass partitions at one or both ends of the exchanger depending on the number of passes required. Typically, in a shell and tube heat exchanger, the tubes are the components most likely to corrode and thus, are the components most likely to require maintenance and/or replacement. For this purpose, and for ease of cleaning, removable bundles are advantageous. However, heat exchangers with more than two passes on the tubeside and with a removable bundle require expensive and awkward designs. Typically these include a return and pass-partitioned inner tubeside bonnet bolted directly to the rear tube sheet in order to seal the bonnet pass-partitions against the tube sheet as the tube bundle expands and contracts, enclosed within the shell. The shell, in turn, must have a shell closure or bonnet. The inner tube side chamber (channel or bonnet) requires a flange which is sealed and bolted to the tubesheet. The portion of the tubesheet that is used for the attachment of the flange is then unavailable for holding the ends of tubes. As a result, the available tube space within the shell is greatly diminished.

It is an object of the present invention to provide an improved shell and tube multi-pass tubeside heat exchanger having a compact design.

It is a further object to provide a multi-pass tubeside heat exchanger having a readily removable tube bundle.

It is a still further object to provide a shell and tube multi-pass heat exchanger of compact design, having more than two passes on the tube side and having a removable bundle.

SUMMARY OF THE INVENTION

The above and other objects are achieved in accordance with the present invention which is directed to a multi-pass tubeside shell and tube heat exchanger comprising:

- an elongated shell having first and second flanged ends, a shell fluid inlet and a shell fluid outlet providing passage of a shell fluid into and out of the shell;
- a removable tube bundle within the shell, comprising a multiplicity of tubes fixed in a first tubesheet at a first end of the tube bundle and fixed in a floating tubesheet at an opposite end of the tube bundle;
- a first head chamber detachably secured to the first end of the shell, the chamber being in fluid communication with the tubes in the first tubesheet and having a tube fluid inlet, a tube fluid outlet, and a plurality of pass-partitions for directing fluid flow through the tubes;
- a false tubesheet detachably secured to the floating tubesheet and having a passage hole aligned with each tube in the floating tubesheet and in fluid communication therewith to direct fluid flow; the false tube sheet preferably having a diameter greater than the diameter of the floating tubesheet;
- a second head chamber having flanges detachably secured to the false tubesheet and in fluid communication with the passage holes therein and having at least one pass-partition for directing fluid flow from and through the tubes.

The materials of construction may vary considerably, depending on the temperatures and pressures to which it will be subjected and nature of the fluids with which it will be used. Most commonly, carbon steel will be employed. However, operation under certain conditions may dictate the use of stainless steel, such as the 300 or 400 series, nickel, Monel, Inconel, copper alloy or other. Sealing means, such as o-rings, packing, gaskets, or the like may be of rubber, polytetrafluoroethylene, metal, asbestos or other materials known for such purpose.

BRIEF DESCRIPTION OF THE DRAWINGS

The present invention and the manner in which it may be practiced is further illustrated by the accompanying drawings wherein.

DETAILED DESCRIPTION OF THE DRAWINGS

Figure 1:
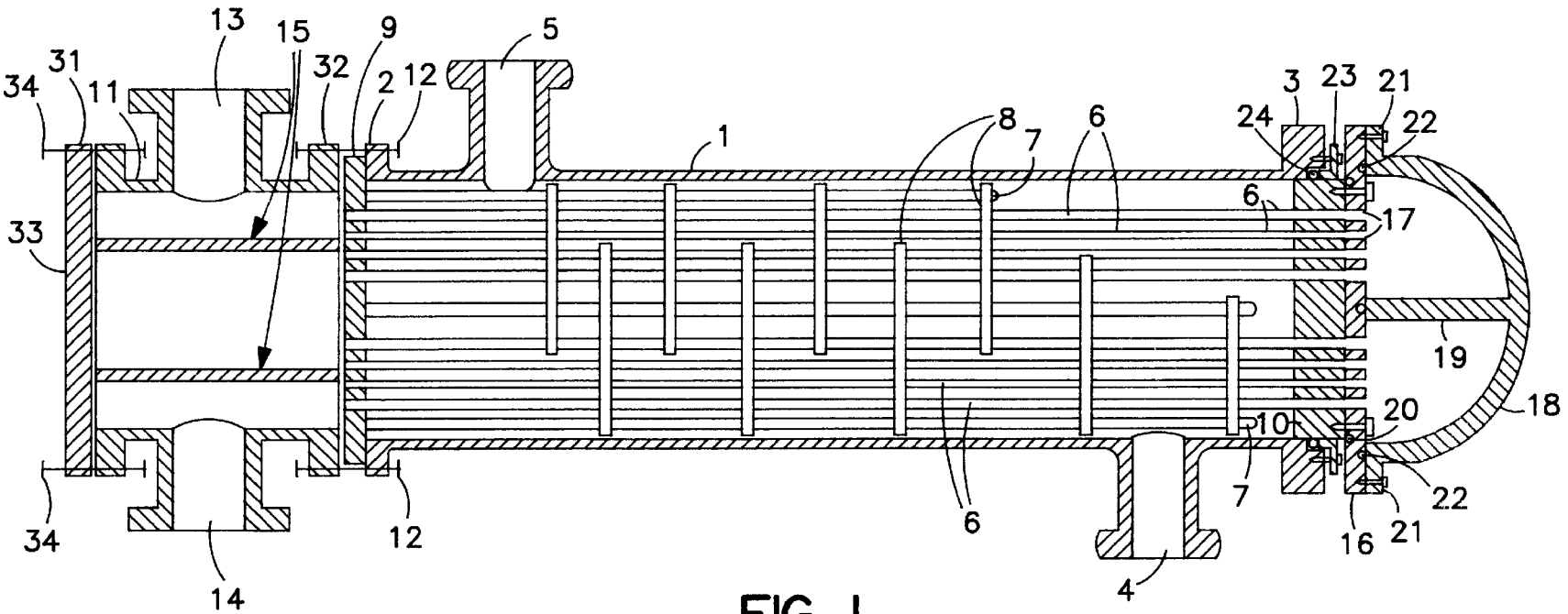
FIG. 1 is a longitudinal section of a heat exchanger according to the present invention.
Figure 2:
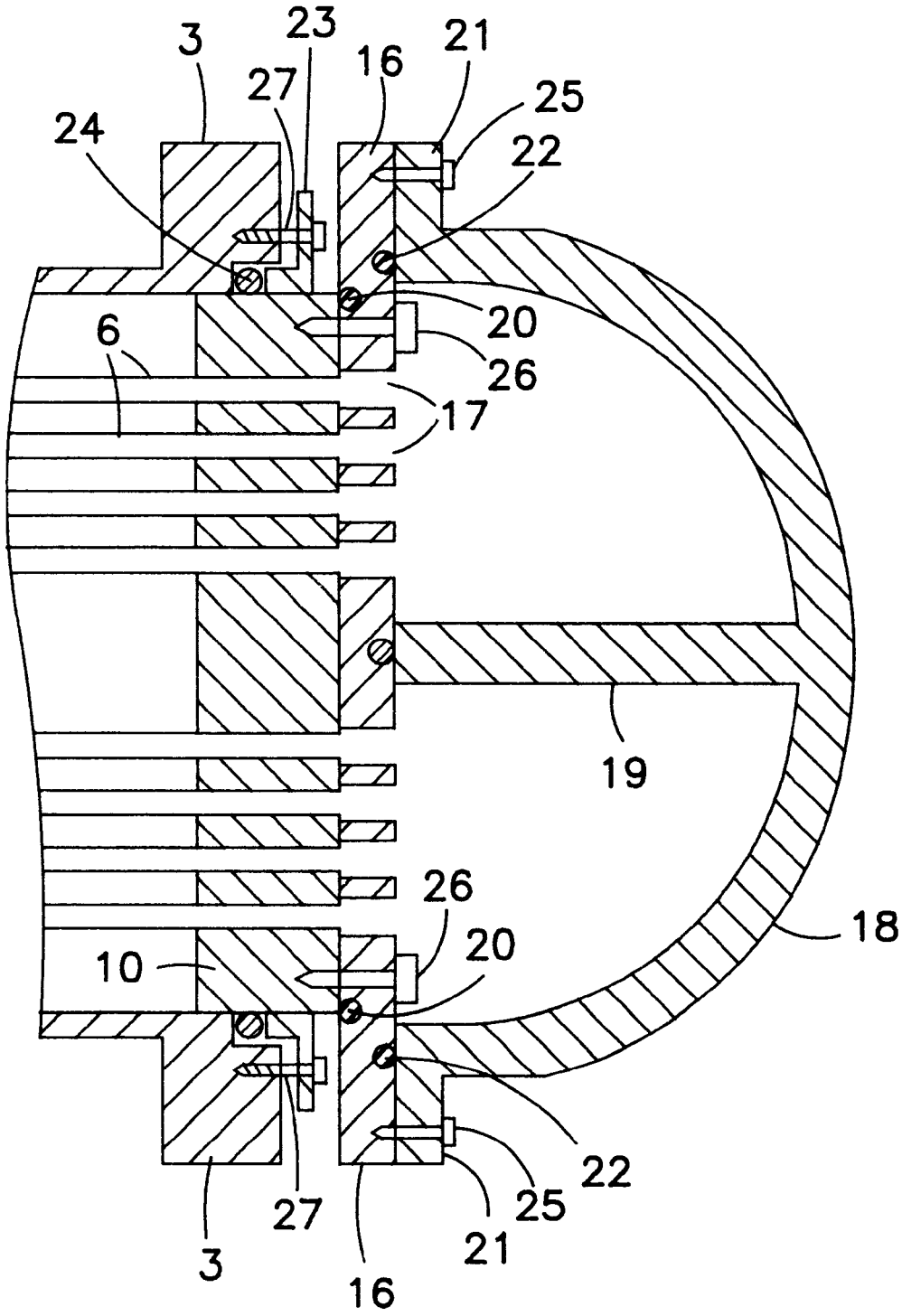
FIG. 2 is an enlarged sectional view of an end of a heat exchanger according to the invention, showing in greater detail, the mounting of the false tubesheet to the floating tubesheet and second head chamber.

With reference to FIGS. 1 and 2, the shell and tube heat exchanger of the present invention comprises an outer shell 1 having first and second flanged ends 2 and 3, respectively, and a shell fluid inlet 4 and a shell fluid outlet 5. Within the shell is a removable tube bundle comprising an array of tubes 6 arranged in parallel rows held in place by tie rods 7 and support plates 8 and end-mounted in first tubesheet 9 and floating tubesheet 10 at the opposite end. A first head chamber 11 having flanges 31 and 32 is detachably secured to flange 2 of shell 1, for example, by flange bolts 12 as shown, or by other means, such as clamps or the like (not shown). The first tubesheet 9 is preferably a fixed tubesheet, held securely in place between flange 32 on the first head chamber and flange 2 on the shell by flange bolts 12. Gaskets (not shown) on each side of tubesheet 9 provide a seal against leakage. Head chamber 11 has a tube fluid inlet 13 and tube fluid outlet 14 and two pass-partitions 15 for directing the flow of tube fluid through tubes 6. A cover plate 33 is secured to flange 31 of the first head chamber 11 by bolts 34 as shown or other means such as clamps or the like (not shown) and the closure sealed, for example with a cover gasket (not shown).

At the opposite end (shown in enlarged detail in FIG. 2), false tubesheet 16 is secured, for example by bolts 26 to floating tubesheet 10 and provides passage holes 17 to allow the passage therethrough of tube fluid from tubes 6. An O-ring 20 serves to provide a seal between the floating tubesheet 10 and false tubesheet 16. In a typical construction the tube ends are fixed in the floating tubesheet, for example, by welding, and project through the tubesheet and extend slightly on the other side. Preferably, the passage holes in the false tubesheet are slightly larger in diameter than the tubes so that they fit over the tube ends and allow the false tubesheet to fit tightly against the tubesheet when it is bolted thereto.

The false tubesheet is preferably of greater diameter than the floating tubesheet 10 to provide a flange portion for the attachment of a second head chamber, bonnet 18 thereto. A seal, preventing the leakage of shell fluid is provided by packing 24 and packing gland 23. The compression of the packing 24 is adjustable by means of bolt 27 securing packing gland 23 to shell flange 3.

A second head chamber (bonnet 18) is secured to the false tubesheet, for example by bolts 25 at the flange 21 thereof, to the outer, or flange, portion of false tubesheet 16. The attachment of bonnet 18 to the outer flange portion of false tubesheet 16 maximizes the available tube space within the shell. An O-ring 22 serves to provide a seal between the false tubesheet and bonnet 18. Bonnet 18 has a pass-partition 19 for directing the flow of tube fluid from and through the tubes 6 and passage holes 17. It will be apparent to those skilled in the art that either a channel type or bonnet type head chamber may be employed. For economic considerations as well as compactness of design, the bonnet type of head chamber may be preferred.

The embodiment of the invention as illustrated includes two pass-partitions 15 in the first head chamber and a single pass-partition 19 in the second head chamber to direct the flow of tube fluid through the tubes for a total four passes. Those skilled in the art will recognize that the flow of tube fluid may be directed to provide other numbers of passes by varying the number of tubes and the number and positioning of pass-partitions at each end in a known manner.

For maintenance and repair of the tubes, the tube bundle may be conveniently removed from the shell 1 by unbolting the first head chamber 11 at one end and the false tubesheet 16 and bonnet 18 at the other end and sliding the tube bundle out of the shell.

While the invention has been described with reference to various preferred embodiments thereof, it will be understood by those skilled in the art that various changes in form and detail may be made without departing from the spirit and scope of the invention as defined in the following claims.

What is claimed is:

1. A shell and tube heat exchanger comprising:

A) an elongated shell having first and second flanged ends, a shell fluid inlet and a shell fluid outlet for providing passage of a shell fluid into and out of said shell;

B) a removable tube bundle within said shell, comprising a multiplicity of tubes fixed in a first tubesheet at a first end of said tube bundle and fixed in a floating tubesheet at an opposite end of said tube bundle;

C) a first head chamber detachably secured to the first flanged end of said shell and in fluid communication with the tubes in said first tubesheet and having a tube fluid inlet, a tube fluid outlet, and a plurality of pass-partitions for directing fluid flow through said tubes;

D) a false tubesheet detachably secured to the floating tubesheet and having a multiplicity of passage holes, each aligned with a tube fixed in the floating tubesheet and in fluid communication therewith to direct fluid flow; said false tubesheet having a flange portion extending outwardly beyond said floating tubesheet;

E) a second head chamber having a flange detachably secured to the flange portion of said false tubesheet and having a chamber in fluid communication with the passage holes and having at least one pass-partition for directing fluid flow from and through said tubes.

2. A shell and tube heat exchanger according to claim 1 wherein said passage holes in said false tubesheet are of greater diameter than said tubes.

3. A shell and tube heat exchanger according to claim 1 wherein said first head chamber is a channel type chamber.

4. A shell and tube heat exchanger according to claim 1 wherein said second head chamber is a bonnet type chamber.

5. A shell and tube heat exchanger according to claim 3 wherein said first tubesheet is a stationary tubesheet.

6. A shell and tube heat exchanger according to claim 5 wherein said first head chamber is secured to the first flanged end of said shell by bolts and said stationary tubesheet is held in place between said first head chamber and said flanged end of said shell.

7. A shell and tube heat exchanger according to claim 1 wherein said false tubesheet is bolted to said floating tubesheet and said second head chamber is secured by flange bolts to said false tubesheet.

8. A shell and tube heat exchanger according to claim 1 having four tubeside passes.

9. A shell and tube heat exchanger according to claim 8 wherein said first head chamber has two tubeside pass-partitions and said second head chamber has one tubeside pass-partition.

10. A shell and tube heat exchanger comprising:

A) an elongated shell having first and second flanged ends, a shell fluid inlet and a shell fluid outlet for providing passage of a shell fluid into and out of said shell;

B) a removable tube bundle within said shell, comprising a multiplicity of tubes fixed in a stationary tubesheet at a first end of said tube bundle and fixed in a floating tubesheet at an opposite end of said tube bundle;

C) a head chamber having a flange bolted to the first flanged end of said shell and in fluid communication with the tubes in said stationary tubesheet and having a tube fluid inlet, a tube fluid outlet, and a plurality of pass-partitions for directing fluid flow through said tubes;

D) a false tubesheet detachably secured to the floating tubesheet and having a multiplicity of passage holes, each aligned with a tube fixed in the floating tubesheet and in fluid communication therewith to direct fluid flow; said passage holes having a diameter greater than the diameter of said tube said false tubesheet having a flange portion extending outwardly beyond said floating tubesheet;

E) a head chamber detachably secured by flange bolts to the flange portion of said false tubesheet and having a chamber in fluid communication with said passage holes and having at least one pass-partition for directing fluid flow from and through said tubes.

* * * * *